US010844454B2

(12) United States Patent
Miyamoto et al.

(10) Patent No.: US 10,844,454 B2
(45) **Date of Patent: *Nov. 24, 2020**

(54) HIGH-CARBON HOT-ROLLED STEEL SHEET AND METHOD FOR MANUFACTURING THE SAME

(71) Applicant: JFE STEEL CORPORATION, Tokyo (JP)

(72) Inventors: Yuka Miyamoto, Kawasaki (JP); Takashi Kobayashi, Chiba (JP); Kaneharu Okuda, Sendai (JP)

(73) Assignee: JFE STEEL CORPORATION, Tokyo (JP)

( * ) Notice: Subject to any disclaimer, the term of this patent is extended or adjusted under 35 U.S.C. 154(b) by 394 days.

This patent is subject to a terminal disclaimer.

(21) Appl. No.: 15/129,449

(22) PCT Filed: Mar. 26, 2015

(86) PCT No.: PCT/JP2015/001713

§ 371 (c)(1),
(2) Date: Sep. 27, 2016

(87) PCT Pub. No.: WO2015/146174

PCT Pub. Date: Oct. 1, 2015

(65) Prior Publication Data

US 2017/0121786 A1 May 4, 2017

(30) Foreign Application Priority Data

Mar. 28, 2014 (JP) ..... 2014-068738

(51) Int. Cl.

| | |
|---|---|
| ***C21D 9/46*** | (2006.01) |
| ***C22C 38/60*** | (2006.01) |
| ***C22C 38/32*** | (2006.01) |
| ***C22C 38/18*** | (2006.01) |
| ***C22C 38/00*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C21D 8/02*** | (2006.01) |
| ***C22C 38/12*** | (2006.01) |

(52) U.S. Cl.

CPC ..... *C21D 9/46* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/18* (2013.01); *C22C 38/32* (2013.01); *C22C 38/60* (2013.01); *C21D 2211/003* (2013.01); *C21D 2211/005* (2013.01); *C21D 2211/009* (2013.01)

(58) Field of Classification Search

CPC ..... C21D 1/32; C21D 2211/003; C21D 2211/005; C21D 6/005; C21D 6/008; C21D 8/0205; C21D 8/0225; C21D 8/0263; C21D 9/46; C22C 38/00; C22C 38/001; C22C 38/002; C22C 38/008; C22C 38/02; C22C 38/04; C22C 38/06; C22C 38/08; C22C 38/12; C22C 38/18; C22C 38/32; C22C 38/60

See application file for complete search history.

(56) References Cited

U.S. PATENT DOCUMENTS

| | | | |
|---|---|---|---|
| 2009/0065106 | A1 | 3/2009 | Kimura et al. |
| 2015/0000801 | A1 | 1/2015 | Miyamoto et al. |
| 2015/0090376 | A1 | 4/2015 | Nakamura et al. |

FOREIGN PATENT DOCUMENTS

| | | | | |
|---|---|---|---|---|
| EP | 2103697 | A1 | | 9/2009 |
| JP | H11269601 | A | | 10/1999 |
| JP | 2006-063394 | A | | 3/2006 |
| JP | 2006063394 | A | * | 3/2006 |
| JP | 2007-277696 | A | | 10/2007 |
| JP | 2008-156712 | A | | 7/2008 |
| JP | 2010-255066 | A | | 11/2010 |
| JP | 4752243 | B2 | * | 8/2011 |
| JP | 4782243 | B2 | | 9/2011 |
| JP | 5048168 | B1 | | 10/2012 |
| WO | 2010/106748 | A1 | | 9/2010 |
| WO | 2013/035848 | A1 | | 3/2013 |
| WO | 2013/102982 | A1 | | 7/2013 |
| WO | 2013/102986 | A1 | | 7/2013 |
| WO | 2015/004902 | A1 | | 1/2015 |
| WO | 2015/004906 | A1 | | 1/2015 |

OTHER PUBLICATIONS

Dec. 20, 2017 Office Action issued in Korean Patent Application No. 10-2016-7029880.
Apr. 12, 2017 Office Action issued in Chinese Patent Application No. 201580016874.9.
Feb. 8, 2017 Search Report issued in European Patent Application No. 15769294.8.
May 24, 2018 Office Action issued in U.S. Appl. No. 14/903,842.
Jan. 24, 2019 Office Action issued in U.S. Appl. No. 15/129,520.

(Continued)

*Primary Examiner* — Colleen P Dunn
*Assistant Examiner* — Anthony M Liang
(74) *Attorney, Agent, or Firm* — Oliff PLC

(57) ABSTRACT

A high-carbon hot-rolled steel sheet having a chemical composition containing, by mass %, C: more than 0.40% and 0.63% or less, Si: 0.10% or less, Mn: 0.50% or less, P: 0.03% or less, S: 0.010% or less, sol.Al: 0.10% or less, N: 0.0050% or less, B: 0.0005% or more and 0.0050% or less, and at least one of Sb, Sn, Bi, Ge, Te, and Se in an amount of 0.002% or more and 0.030% or less in total. The steel sheet has a microstructure including ferrite and cementite, in which the density of cementite in ferrite grains is 0.13 pieces/$\mu m^2$ or less. Additionally, the steel sheet has a hardness of 81 or less in terms of HRB and a total elongation of 33% or more.

9 Claims, No Drawings

(56) References Cited

OTHER PUBLICATIONS

Dec. 21, 2018 Office Action issued in Application No. 14/903,842.
Aug. 2, 2019 Office Action issued in U.S. Appl. No. 15/129,520.
Feb. 26, 2020 Office Action issued in U.S. Appl. No. 15/129,520.

* cited by examiner

HIGH-CARBON HOT-ROLLED STEEL SHEET AND METHOD FOR MANUFACTURING THE SAME

TECHNICAL FIELD

The present disclosure relates to a high-carbon hot-rolled steel sheet and a method for manufacturing the steel sheet, and, in particular, to a high-carbon hot-rolled steel sheet excellent in terms of workability and hardenability to which B is added and which is highly effective for inhibiting nitrogen ingress in a surface layer thereof and a method for manufacturing the steel sheet.

BACKGROUND ART

Nowadays, automotive parts such as gears, transmission parts, and seat belt parts are manufactured by forming a hot-rolled steel sheet, which is carbon steel material for machine structural use prescribed in JIS G 4051, into desired shapes by using a cold forming method and by performing a quenching treatment on the formed steel sheet in order to achieve a desired hardness. Therefore, a hot-rolled steel sheet, which is a raw material for the parts, is required to have excellent cold workability and hardenability, and various steel sheets have been proposed to date.

For example, Patent Literature 1 discloses a medium-carbon steel sheet to be subjected to cold forming, the medium-carbon steel sheet having a hardness of 500 HV or more and 900 HV or less in the case where the steel sheet is subjected to an induction hardening treatment in which the steel sheet is heated at an average heating rate of 100° C./s, then held at a temperature of 1000° C. for 10 seconds, and then rapidly cooled to room temperature at an average cooling rate of 200° C./s, having a chemical composition containing, by mass %, C: 0.30% to 0.60%, Si: 0.06% to 0.30%, Mn: 0.3% to 2.0%, P: 0.030% or less, S: 0.0075% or less, Al: 0.005% to 0.10%, N: 0.001% to 0.01%, Cr: 0.001% to 0.10%, and, optionally, one or more of Ni: 0.01% to 0.5%, Cu: 0.05% to 0.5%, Mo: 0.01% to 0.5%, Nb: 0.01% to 0.5%, Ti: 0.001% to 0.05%, V: 0.01% to 0.5%, Ta: 0.01% to 0.5%, B: 0.001% to 0.01%, W: 0.01% to 0.5%, Sn: 0.003% to 0.03%, Sb: 0.003% to 0.03%, and As: 0.003% to 0.03%, a microstructure, in which the average grain diameter d μm of carbides is 0.6 μm or less, in which the spheroidizing ratio P % of carbides is 70% or more and less than 90%, and in which the average grain diameter d μm of the carbides and the spheroidizing ratio P % of the carbides satisfy the relationship $d \leq 0.04 \times P - 2.6$, and, optionally, a hardness of 120 HV or more and less than 170 HV before cold forming is performed. In addition, Patent Literature 1 discloses a method for manufacturing such a medium-carbon steel sheet to be subjected to cold forming in which steel having the chemical composition mentioned above is held at a temperature of 1050° C. to 1300° C., then subjected to hot rolling in which rolling is finished at a temperature of 700° C. to 1000° C., then cooled to a temperature of 500° C. to 700° C. at a cooling rate of 20° C./s to 50° C./s, then cooled to a specified temperature at a cooling rate of 5° C./s to 30° C./s, then coiled, then held under specified conditions, and then annealed at a temperature of 600° C. or higher and equal to or lower than the $Ac_1 - 10°$ C.

In addition, Patent Literature 2 discloses a medium-carbon steel sheet having a chemical composition containing, by mass %, C: 0.10% to 0.80%, Si: 0.01% to 0.3%, Mn: 0.3% to 2.0%, Al: 0.001% to 0.10%, N: 0.001% to 0.01%, P: 0.03% or less, S: 0.01% or less, O: 0.0025% or less, Cr: 1.5% or less, B: 0.01% or less, Nb: 0.5% or less, Mo: 0.5% or less, V: 0.5% or less, Ti: 0.3% or less, Cu: 0.5% or less, W: 0.5% or less, Ta: 0.5% or less, Ni: 0.5% or less, Mg: 0.003% or less, Ca: 0.003% or less, Y: 0.03% or less, Zr: 0.03% or less, La: 0.03% or less, Ce: 0.03% or less, Sn: 0.03% or less, Sb: 0.03% or less, As: 0.03% or less, and the balance being Fe and inevitable impurities, a microstructure in which the average grain diameter of carbides is 0.4 μm or less, in which the proportion of the number of carbides having a grain diameter of 1.5 times or more the average grain diameter of the carbides to the total number of the carbides is 30% or less, in which the spheroidizing ratio of the carbides is 90% or more, in which the average ferrite grain diameter is 10 μm or more, and in which the tensile strength TS is 550 MPa or less. In addition, Patent Literature 2 discloses a method for manufacturing such a medium-carbon steel sheet in which steel having the chemical composition mentioned above is cast, then subjected to hot rolling, then cooled with air for 2 seconds to 10 seconds immediately after hot rolling has been performed, then cooled at an average cooling rate of 10° C./s to 80° C./s in a temperature range from the air cooling stop temperature to a temperature of 480° C. to 600° C., then coiled at a temperature of 400° C. to 580° C., then subjected to cold rolling with a cold rolling reduction of 5% or more and less than 30%, and annealed at a temperature of 650° C. to 720° C. for 5 hours to 40 hours.

In addition, Patent Literature 3 discloses a boron-added steel sheet having a chemical composition containing, by mass %, C: 0.20% or more and 0.45% or less, Si: 0.05% or more and 0.8% or less, Mn: 0.5% or more and 2.0% or less, P: 0.001% or more and 0.04% or less, S: 0.0001% or more and 0.006% or less, Al: 0.005% or more and 0.1% or less, Ti: 0.005% or more and 0.2% or less, B: 0.001% or more and 0.01% or less, N: 0.0001% or more and 0.01% or less, and, optionally, one, two, or more of Cr: 0.05% or more and 0.35% or less, Ni: 0.01% or more and 1.0% or less, Cu: 0.05% or more and 0.5% or less, Mo: 0.01% or more and 1.0% or less, Nb: 0.01% or more and 0.5% or less, V: 0.01% or more and 0.5% or less, Ta: 0.01% or more and 0.5% or less, W: 0.01% or more and 0.5% or less, Sn: 0.003% or more and 0.03% or less, Sb: 0.003% or more and 0.03% or less, and As: 0.003% or more and 0.03% or less, in which an average concentration of a solid solution B in a region from the surface to a depth of 100 μm is 10 ppm or more. In addition, Patent Literature 3 discloses that, in the case where annealing is performed in an atmosphere mainly containing nitrogen, since a phenomenon called nitrogen absorption occurs, B, which is an important chemical element from the viewpoint of hardenability, combines with N in steel to form BN in an annealing process, which results in the effect of increasing hardenability through the use of B not being realized due to a decrease in the amount of a solid solution B. Patent Literature 3 discloses that, in order to achieve satisfactory hardenability, it is necessary to control the concentration of a solid solution B in a region from the surface to a depth of 100 μm to be 10 ppm or more, and that, therefore, it is important to suppress the influence of the atmosphere of a heating process and an annealing process included in a manufacturing process. In addition, Patent Literature 3 discloses a method for manufacturing such a boron-added steel sheet in which steel having the chemical composition mentioned above is heated to a temperature of 1200° C. or lower, then subjected to hot rolling with a finishing delivery temperature of 800° C. to 940° C., then cooled to a temperature of 650° C. or lower at a cooling rate of 20° C./s or more, then cooled at a cooling rate of 20° C./s or less, then coiled at a temperature of 400° C. to 650° C., then pickled, and then annealed at a temperature of 660° C. or higher and equal to or lower than the $Ac_1$ in an atmosphere in which hydrogen concentration is 95% or more, the dew point in a temperature range lower than 400° C. is −20° C. or lower, and the dew point in a temperature range of 400° C. or higher is −40° C. or lower.

CITATION LIST

Patent Literature

PTL 1: Japanese Patent No. 5048168
PTL 2: WO2013/035848
PTL 3: Japanese Patent No. 4782243

SUMMARY

Technical Problem

Since many of the parts of an automotive power train and the like are required to have abrasion resistance, such parts are required to have high hardenability and high hardness after quenching has been performed, that is, for example, a Vickers hardness of more than HV620. On the other hand, in the case where, for example, automotive parts, which have been manufactured by performing plural processes such as hot forging, machining, and welding, are integrally molded by performing cold press forming, the automotive parts are required to have comparatively low hardness and high elongation from the viewpoint of achieving good cold workability.

In the case of the technique according to Patent Literature 1 where the average grain diameter of carbides is controlled to be 0.6 μm or less in order to achieve quenching hardenability to be realized in an induction hardening treatment which is performed at an average heating rate of 100° C./s, since the average grain diameter of carbides is controlled to be 0.6 μm or less in steel having a high C content of 0.3% to 0.6%, there is a tendency for strength to increase due to high density of carbides, which raises a risk of a decrease in workability. In addition, since, in the manufacturing method according to Patent Literature 1, two-step cooling control, in which cooling is performed to a temperature of 500° C. to 700° C. at a cooling rate of 20° C./s to 50° C./s after hot rolling has been performed, and then cooling is performed at a cooling rate of 5° C./s to 30° C./s, is performed, there is a problem in that it is difficult to control cooling.

In the case of the technique according to Patent Literature 2 where, by performing cold rolling with a cold rolling reduction of 5% or more on a hot-rolled steel sheet, the hardness of a steel sheet is decreased by promoting grain growth and recrystallization in an annealing process performed thereafter, since there is an increase in cost due to an increase in the number of processes in cold rolling before annealing is performed, it is preferable that hardness be decreased without performing cold rolling.

Also, in the case of the technique according to Patent Literature 3 where two-step cooling control, in which cooling is performed to a temperature of 650° C. or lower at a cooling rate of 20° C./s or more after hot rolling has been performed, and then cooling is performed at a cooling rate of 20° C./s or lower, is performed, there is a problem in that it is difficult to manage a cooling control. Moreover, in the case of the technique according to Patent Literature 3, Mn is added in an amount of 0.5% or more in order to increase hardenability. Although Mn increases hardenability, since there is an increase in the strength of a hot-rolled steel sheet through solid solution strengthening, there is an increase in the hardness of the hot-rolled steel sheet.

On the other hand, B is known as chemical element that increases hardenability when added in minute amounts, however, as described in Patent Literature 3, in the case where annealing is performed in an atmosphere containing mainly nitrogen, which is generally used as an atmospheric gas, there is a problem in that it is not possible to realize the effect of increasing hardenability caused by adding B due to a decrease in the amount of a solid solution B. Although, in Patent Literature 3, such a problem is solved by performing annealing in an atmosphere containing 95% or more of hydrogen or in an atmosphere in which an inert gas such as Ar is used instead of hydrogen, there is an increase in cost in the case of a heat treatment in which such a gas is used. In addition, it is not clear whether or not it is possible to inhibit nitrogen absorption in an annealing process performed in a nitrogen atmosphere only with this technique.

An object of the present disclosure is, in order to solve the problems described above, to provide a high-carbon hot-rolled steel sheet whose raw material is B-added steel, with which it is possible to stably achieve excellent hardenability even if annealing is performed in a nitrogen atmosphere, and which has excellent workability corresponding to a hardness of 81 or less in terms of HRB and to a total elongation of 33% or more before a quenching treatment is performed and a method for manufacturing the steel sheet.

Solution to Problem

The present inventors diligently conducted investigations regarding the relationship between manufacturing conditions and workability and hardenability, in the case of a B-added high-carbon hot-rolled steel sheet having lower Mn content than conventional steel, that is, a Mn content of 0.50% or less, and, as a result, obtained the following knowledge.

i) The hardness and total elongation (hereafter, also simply referred to as elongation) of a high-carbon hot-rolled steel sheet before a quenching treatment is performed are strongly influenced by the density of cementite in ferrite grains. In order to obtain a steel sheet having a hardness of 81 or less in terms of HRB and a total elongation (El) of 33% or more, it is necessary that the density of cementite in ferrite grains be 0.13 pieces/$\mu m^2$ or less.

ii) The density of cementite in ferrite grains is strongly influenced by the finishing delivery temperature of finish rolling included in hot rolling and a cooling rate down to a temperature of 700° C. after finish rolling has been performed. In the case where the finishing delivery temperature is excessively high or where the cooling rate is excessively low, since in a steel sheet after hot rolling has been performed it is not possible to form a microstructure which includes ferrite which has a specified ferrite phase fraction and pearlite, it is difficult to decrease the density of cementite after spheroidizing annealing has been performed.

iii) By adding at least one of Sb, Sn, Bi, Ge, Te, and Se to steel, since it is possible to prevent nitrogen ingress even if annealing is performed in a nitrogen atmosphere, it is possible to achieve high hardenability by inhibiting a decrease in the amount of a solid solution B.

The present disclosure has been completed on the basis of such knowledge, and exemplary disclosed embodiments include as follows.

[1] A high-carbon hot-rolled steel sheet having a chemical composition containing, by mass %, C: more than 0.40% and 0.63% or less, Si: 0.10% or less, Mn: 0.50% or less, P: 0.03% or less, S: 0.010% or less, sol.Al: 0.10% or less, N: 0.0050% or less, B: 0.0005% or more and 0.0050% or less, one or more of Sb, Sn, Bi, Ge, Te, and Se in an amount of 0.002% or more and 0.030% or less in total, and the balance being Fe and inevitable impurities, in which the proportion of the content of a solid solution B to the content of B is 70% or more, a microstructure including ferrite and cementite, in which the density of cementite in the ferrite grains is 0.13 pieces/$\mu m^2$ or less, a hardness of 81 or less in terms of HRB, and a total elongation of 33% or more.

[2] The high-carbon hot-rolled steel sheet according to item [1] above, the steel sheet having the chemical composition further containing, by mass %, one or more of Ni, Cr, and Mo in an amount of 0.50% or less in total.

[3] The high-carbon hot-rolled steel sheet according to item [1] or [2] above, the steel sheet having the microstructure including ferrite and cementite, in which the average grain diameter of all the cementite is 0.60 μm or more and 1.00 μl or less, and in which the average grain diameter of cementite in ferrite grains is 0.40 μm or more.

[4] A method for manufacturing a high-carbon hot-rolled steel sheet, the method including performing hot rough rolling on steel having a chemical composition containing, by mass %, C: more than 0.40% and 0.63% or less, Si: 0.10% or less, Mn: 0.50% or less, P: 0.03% or less, S: 0.010% or less, sol.Al: 0.10% or less, N: 0.0050% or less, B: 0.0005% or more and 0.0050% or less, one or more of Sb, Sn, Bi, Ge, Te, and Se in an amount of 0.002% or more and 0.030% or less in total, and the balance being Fe and inevitable impurities, then performing hot finish rolling with a finishing delivery temperature equal to or higher than the $Ar_3$ transformation temperature and 870° C. or lower, then cooling the hot-rolled steel sheet to a temperature of 700° C. at an average cooling rate of 25° C./s or more and 150° C./s or less, then coiling the cooled steel sheet at a coiling temperature of 500° C. or higher and 700° C. or lower in order to obtain a steel sheet having a microstructure including pearlite and, in terms of volume fraction, 5% or more of pro-eutectoid ferrite, and then annealing the steel sheet at a temperature equal to or lower than the $Ac_1$ transformation temperature.

[5] The method for manufacturing a high-carbon hot-rolled steel sheet according to item [4] above, the steel having the chemical composition further containing, by mass %, one or more of Ni, Cr, and Mo in an amount of 0.50% or less in total.

Advantageous Effects

According to the present disclosure, it is possible to manufacture a high-carbon hot-rolled steel sheet excellent in terms of hardenability and workability. The high-carbon hot-rolled steel sheet according to the disclosure can be used for automotive parts such as gears, transmission parts, and seat belt parts whose raw material steel sheet is required to have satisfactory cold workability.

DESCRIPTION OF EMBODIMENTS

Hereafter, the high-carbon hot-rolled steel sheet and the method for manufacturing the steel sheet according to the present disclosure will be described in detail. Here, "%", which is the unit of the content of a constituent chemical element, refers to "mass %", unless otherwise noted.

1) Chemical Composition

C: More than 0.40% and 0.63% or Less

C is a chemical element which is important for achieving strength after quenching has been performed. In the case where the C content is 0.40% or less, it is not possible to achieve the desired hardness by performing a heat treatment after a part has been formed, or, specifically, it is not possible to achieve a hardness of more than HV620 after water quenching has been performed. Therefore, it is necessary that the C content be more than 0.40%. On the other hand, in the case where the C content is more than 0.63%, since there is an increase in the hardness of a steel sheet, there is a decrease in cold workability. Therefore, the C content is set to be 0.63% or less, or preferably 0.53% or less. It is preferable that the C content be 0.42% or more in order to achieve a high quenched hardness. It is more preferable that the C content be 0.45% or more, because it is possible to stably achieve a hardness of HV620 or more after water quenching has been performed.

Si: 0.10% or Less

Si is a chemical element which increases strength through solid solution strengthening. Since hardness increases with increasing Si content, there is a decrease in cold workability. Therefore, the Si content is set to be 0.10% or less, preferably 0.05% or less, or more preferably 0.03% or less. Although it is preferable that the Si content be as small as possible because Si decreases cold workability, since there is an increase in refining costs in the case where the Si content is excessively decreased, it is preferable that the Si content be 0.005% or more.

Mn: 0.50% or Less

Although Mn is a chemical element which increases hardenability, but, on the other hand, Mn is also a chemical element which increases strength through solid solution strengthening. In the case where the Mn content is more than 0.50%, there is a decrease in cold workability due to an excessive increase in the hardness of a steel sheet. In addition, since a band structure grows due to the segregation of Mn and a non-uniform microstructure is formed, there is a tendency for a variation in hardness and elongation to increase. Therefore, the Mn content is set to be 0.50% or less, preferably 0.45% or less, or more preferably 0.40% or less. Here, although there is no particular limitation on the lower limit of the Mn content, it is preferable that the Mn content be 0.20% or more in order to achieve the specified quenched hardness by allowing all the C in a steel sheet to form a solid solution in a heating process for a quenching treatment as a result of inhibiting the precipitation of graphite.

P: 0.03% or Less

P is a chemical element which increases strength through solid solution strengthening. In the case where the P content is more than 0.03%, there is a decrease in cold workability due to an excessive increase in the hardness of a steel sheet. In addition, since there is a decrease in the strength of grain boundaries, there is a decrease in toughness after quenching has been performed. Therefore, the P content is set to be 0.03% or less. It is preferable that the P content be 0.02% or less in order to achieve excellent toughness after quenching has been performed. Although it is preferable that the P content be as small as possible because P decreases cold workability and toughness after quenching has been performed, since there is an increase in refining costs in the case where the P content is decreased more than necessary, it is preferable that the P content be 0.005% or more.

S: 0.010% or Less

Since S forms sulfides and decreases the cold workability of a high-carbon hot-rolled steel sheet and toughness after quenching has been performed, S is a chemical element whose content should be decreased. In the case where the S content is more than 0.010%, there is a significant decrease in the cold workability of a high-carbon hot-rolled steel sheet and toughness after quenching has been performed. Therefore, the S content is set to be 0.010% or less. It is preferable that the S content be 0.005% or less in order to achieve excellent cold workability and excellent toughness after quenching has been performed. Although it is preferable that the S content be as small as possible because S decreases cold workability and toughness after quenching has been performed, since there is an increase in refining costs in the case where the S content is decreased more than necessary, it is preferable that the S content be 0.0005% or more.

sol.Al: 0.10% or Less

In the case where the sol.Al content is more than 0.10%, since there is an excessive decrease in austenite grain diameter due to the formation of AlN in a heating process for a quenching treatment, a microstructure including ferrite and martensite is formed as a result of promoting the formation of a ferrite phase in a cooling process, which results in a decrease in hardness after quenching has been performed. Therefore, the sol.Al content is set to be 0.10% or less, or preferably 0.06% or less. Here, Al is effective for deoxidation, and it is preferable that the sol.Al content be 0.005% or more in order to sufficiently perform deoxidation.

N: 0.0050% or Less

In the case where the N content is more than 0.0050%, since an excessive amount of BN is formed, there is a decrease in the amount of a solid solution B. In addition, since BN and AlN are formed in amounts larger than necessary, there is an excessive decrease in austenite grain diameter in a heating process for a quenching treatment, the formation of a ferrite phase is promoted in a cooling process, which results in a decrease in hardness after quenching has been performed. Therefore, the N content is set to be 0.0050% or less, or preferably 0.0045% or less. Here, although there is no particular limitation on the lower limit of the N content, N forms BN and AlN as described above. In the case where appropriate amounts of BN and AlN are formed, since such nitrides suitably inhibit an increase in austenite grain diameter in a heating process for a quenching treatment, there is an increase in toughness after quenching has been performed. Therefore, it is preferable that the N content be 0.0005% or more.

B: 0.0005% or More and 0.0050% or Less

B is an important chemical element which increases hardenability. Under the condition regarding the cooling rate after finish rolling has been performed in hot rolling according to the present disclosure, in the case where the B content is less than 0.0005%, since there is an insufficient amount of a solid solution B, which delays ferrite transformation, it is not possible to realize sufficient effect of increasing hardenability. Therefore, it is necessary that the B content be 0.0005% or more, or preferably 0.0010% or more. On the other hand, in the case where the B content is more than 0.0050%, the recrystallization of austenite after finish rolling has been performed is delayed. As a result, since the rolled texture of a hot-rolled steel sheet grows, there is an increase in the in-plane anisotropy of the mechanical properties of a steel sheet after annealing has been performed. Therefore, since earing tends to occur and there is a decrease in roundness when drawing is performed, problems tend to occur when forming is performed. Therefore, it is necessary that the B content be 0.0050% or less. It is preferable that the B content be 0.0035% or less from the viewpoint of increasing hardenability and of decreasing anisotropy. Therefore, the B content is set to be 0.0005% or more and 0.0050% or less, or preferably 0.0010% or more and 0.0035% or less.

The Proportion of the Content of a Solid Solution B to the Content of B: 70% or More In the present disclosure, in addition to the optimization of the B content described above, the control of the amount of a solid solution B, which contributes to an increase in hardenability, is important. In the case where the proportion of the amount of B present in a solid solution state to the amount of B contained in a steel sheet is 70% or more, that is, in the case where the proportion of the content of a solid solution B to the total content of B (B content) in a steel sheet is 70% or more, it is possible to achieve excellent hardenability targeted in the present disclosure. Therefore, the proportion of the content of a solid solution B to the content of B is set to be 70% or more, or preferably 75% or more. Here, "the proportion of the content of a solid solution B to the content of B" refers to {(content of a solid solution B (mass %))/(total B content (mass %))}×100(%).

One or More of Sb, Sn, Bi, Ge, Te, and Se: 0.002% or More and 0.030% or Less in Total Sb, Sn, Bi, Ge, Te, and Se are all chemical elements which are effective for inhibiting nitrogen ingress through the surface of a steel sheet, and it is necessary that one or more of Sb, Sn, Bi, Ge, Te, and Se be added in the disclosed embodiments. In addition, in the case where the total content of these chemical elements is less than 0.002%, sufficient effect of inhibiting nitrogen ingress is not realized. Therefore, one or more of Sb, Sn, Bi, Ge, Te, and Se is added in an amount of 0.002% or more in total, or preferably 0.005% or more in total. On the other hand, in the case where the total content of these chemical elements is more than 0.030%, the effect of inhibiting nitrogen ingress becomes saturated. In addition, since these chemical elements tend to be segregated at grain boundaries, grain boundary embrittlement may occur in the case where the total content of these chemical elements is more than 0.030%. Therefore, in the disclosed embodiments, one or more of Sb, Sn, Bi, Ge, Te, and Se is added in an amount of 0.030% or less in total, or preferably 0.020% or less.

As described above, by controlling the N content to be 0.0050% or less, and by adding one or more of Sb, Sn, Bi, Ge, Te, and Se in an amount of 0.002% or more and 0.030% or less in total, since it is possible to inhibit an increase in nitrogen concentration in the surface layer of a steel sheet by inhibiting nitrogen ingress through the surface of the steel sheet even in the case where annealing is performed in a nitrogen atmosphere, it is possible to control the difference between an average nitrogen concentration in a region from the surface to a depth of 150 μm in the thickness direction of the steel sheet and an average nitrogen concentration in the whole steel sheet to be 30 mass ppm or less. In addition, since it is possible to inhibit nitrogen ingress as described above, it is possible to control the proportion of the content of a solid solution B to the content of B to be 70% or more in a steel sheet after annealing has been performed even if annealing is performed in a nitrogen atmosphere.

In the case where the difference between an average nitrogen concentration in a region from the surface to a depth of 150 μm in the thickness direction of the steel sheet and an average nitrogen concentration in the whole steel sheet is more than 30 mass ppm, there is an increase in the difference between the amounts of BN and AlN formed in the surface layer of the steel sheet and the amounts of BN and AlN formed in the central portion in the thickness direction of the steel sheet. In this case, there is a problem such as one in that it is not possible to achieve uniform hardness distribution after a quenching treatment has been performed. Therefore, it is necessary to suppress the difference between an average nitrogen concentration in a region from the surface to a depth of 150 μm in the thickness direction of the steel sheet and an average nitrogen concentration in the whole steel sheet to be 30 mass ppm or less.

Although remainder other than those above is Fe and inevitable impurities, one or more of Ni, Cr, and Mo may be added in order to further increase hardenability. In order to realize such an effect, it is preferable that one or more of Ni, Cr, and Mo be added and that the total content of these chemical elements be 0.01% or more. On the other hand, since these chemical elements are expensive, in the case where one or more of Ni, Cr, and Mo are added, it is necessary that the total content of these chemical elements be 0.50% or less, or preferably 0.20% or less.

2) Microstructure

In the present disclosure, in order to increase cold workability, it is necessary that a microstructure including ferrite and cementite be formed by performing annealing (spheroidizing annealing), in which spheroidal cementite is formed, after hot rolling has been performed. Here, "spheroidal" refers to a case where the proportion of the amount of cementite having an aspect ratio (the length of major axis/the length of minor axis) of 3 or less to the total amount of cementite is 90% or more in terms of volume fraction. In particular, in order to achieve a Rockwell hardness of 81 or less in terms of HRB and a total elongation of 33% or more, it is necessary that the density of cementite in ferrite grains be 0.13 pieces/$\mu m^2$ or less. Hereinafter, "the density of cementite" is also referred to as "the number density of cementite grains".

Number Density of Cementite Grains in Ferrite Grains: 0.13 Pieces/$\mu m^2$ or Less The steel sheet according to the present disclosure has a microstructure including ferrite and cementite. In the case where the number density of cementite grains in ferrite grains is high, deformation is inhibited more or less, which results in an increase in hardness and a decrease in elongation. In order to control hardness to be equal to or less than the specified value and in order to control elongation to be equal to or more than the specified value, it is necessary that the number density of cementite grains in ferrite grains be 0.13 pieces/$\mu m^2$ or less, preferably 0.11 pieces/$\mu m^2$ or less, or more preferably 0.10 pieces/$\mu m^2$ or less. Since the length of the major axis of cementite grains in ferrite grains is about 0.15 μm to 1.8 μm, the sizes of cementite grains slightly contributes to precipitation strengthening of a steel sheet. Therefore, it is possible to decrease strength by decreasing the number density of cementite grains in ferrite grains. Since cementite grains existing at ferrite grain boundaries scarcely contribute to dispersion strengthening, the number density of cementite grains in ferrite grains is set to be 0.13 pieces/$\mu m^2$ or less. Here, it is acceptable that remaining microstructures such as pearlite other than ferrite and cementite described above be inevitably formed in the case where the total volume fraction of the remaining microstructures be about 5% or less, because the effects of the present disclosure are not decreased.

Average Grain Diameter of all the Cementite: 0.60 μm or More and 1.00 μm or Less and Average Grain Diameter of Cementite in Ferrite Grains: 0.40 μm or More In the case of a steel sheet in which the average grain diameter of cementite in ferrite grains is less than 0.40 μm, since there is an increase in the number density of cementite grains in ferrite grains, there is a case where there is an increase in the hardness of the steel sheet after annealing has been performed. In order to control hardness to be equal to or less than the desired value, it is preferable that the average grain diameter of cementite in ferrite grains be 0.40 μm or more, or more preferably 0.45 μm or more.

Since the grain diameter of cementite at ferrite grain boundaries is more likely to increase than that of cementite in ferrite grains, it is necessary that the average grain diameter of all the cementite be 0.60 μm or more, or preferably 0.65 μm or more, in order to control the average grain diameter of cementite in ferrite grains to be 0.40 μm or more. On the other hand, in the case where the average grain diameter of all the cementite is more than 1.00 μm, since cementite is not completely dissolved in a short-time heating such as heating for an induction hardening treatment, there is a case where it is not possible to control hardness to be equal to or less than the desired value. Therefore, it is preferable that the average grain diameter of all the cementite be 1.00 μm or less, or more preferably 0.95 μm or less. Regarding the average grain diameter of cementite described above, it is possible to determine the average grain diameter of all the cementite and the average grain diameter of cementite in ferrite grains by observing the microstructure by using a SEM and by determining the lengths of the major axis and minor axis of cementite grains.

Here, in the case where the grain diameter of ferrite is excessively large, although there is a decrease in hardness, since there is a case where the effect of increasing elongation becomes saturated, it is preferable that the average grain diameter of ferrite be 12 μm or less, or more preferably 9 μm or less, in the microstructure including ferrite and cementite described above. On the other hand, in the case where the average grain diameter of ferrite is less than 6 μm, there is a case where there is an increase in the hardness of a steel sheet. Therefore, it is preferable that the average grain diameter of ferrite be 6 μm or more. It is possible to determine the grain diameter of ferrite described above by observing the microstructure by using a SEM.

3) Mechanical Properties

In the present disclosure, since automotive parts such as gears, transmission parts, and seat belt parts are formed by performing cold press forming, excellent workability is required. In addition, it is necessary to provide abrasion resistance to the parts by increasing hardness by performing a quenching treatment. Therefore, in addition to increasing hardenability, it is necessary to decrease the hardness of a steel sheet to 81 or less in terms of HRB and to increase elongation to total elongation (El) 33% or more. Although it is preferable that the hardness of a steel sheet be as low as possible from the viewpoint of workability, since some parts are partially subjected quenching, the strength of a raw material steel sheet influences fatigue characteristics. Here, it is possible to determine hardness in terms HRS described above by using a Rockwell hardness meter (B scale). In addition, it is possible to determine total elongation by performing a tensile test at a tensile speed of 10 mm/min on a JIS No. 5 tensile test piece which has been taken in a direction (L-direction) at an angle of 0° to the rolling direction by using tensile test machine AG-10TB AG/XR produced by SHIMADZU CORPORATION and by butting the pieces of a broken sample.

4) Manufacturing Condition

The high-carbon hot-rolled steel sheet according to the present disclosure is manufactured by using raw material steel having the chemical composition described above, by performing hot rolling including performing hot rough rolling and then performing hot finish rolling with a finishing delivery temperature equal to or higher than the $Ar_3$ transformation temperature and 870° C. or lower in order to obtain a desired thickness, by then cooling the hot-rolled steel sheet to a temperature of 700° C. at an average cooling rate of 25° C./s or more and 150° C./s or less, by then coiling the cooled steel sheet at a coiling temperature of 500° C. or higher and 700° C. or lower in order to obtain a steel sheet having a microstructure including pearlite and, in terms of volume fraction, 5% or more of pro-eutectoid ferrite, and by then performing spheroidizing annealing on the steel sheet at a temperature equal to or lower than the $Ac_1$ transformation temperature. Here, it is preferable that the rolling reduction of finish rolling be 85% or more.

Hereafter, the reasons for limitations on the method for manufacturing a high-carbon hot-rolled steel sheet according to the present disclosure will be described.

Finishing Delivery Temperature: Equal to or Higher than the $Ar_3$ Transformation Temperature and 870° C. or Lower In order to control the number density of cementite grains in ferrite grains to be 0.13 pieces/$\mu m^2$ or less after annealing has been performed, it is necessary to perform spheroidizing annealing on a hot-rolled steel sheet having a microstructure including pearlite and, in terms of volume fraction, 5% or more of pro-eutectoid ferrite. In the case where the finishing delivery temperature is higher than 870° C. in hot rolling in which finish rolling is performed after hot rough rolling has been performed, since there is a decrease in the proportion of pro-eutectoid ferrite, it is not possible to achieve the specified number density of cementite grains after spheroidizing annealing has been performed. And there is a tendency for cementite grain diameter and ferrite grain diameter to increase after annealing has been performed. Therefore, the finishing delivery temperature is set to be 870° C. or lower. In order to sufficiently increase the proportion of pro-eutectoid ferrite, it is preferable that the finishing delivery temperature be 850° C. or lower. On the other hand, in the case where the finishing delivery temperature is lower than the $Ar_3$ transformation temperature, since ferrite grains having a large grain diameter are formed after hot rolling or annealing has been performed, there is a significant decrease in elongation. Therefore, the finishing delivery temperature is set to be equal to or higher than the $Ar_3$ transformation temperature, or preferably 820° C. or higher. Here, "finishing delivery temperature" refers to the surface temperature of a steel sheet.

Average Cooling Rate from Finishing Delivery Temperature to 700° C.: 25° C./s or More and 150° C./s or Less In order to control the number density of cementite grains in ferrite grains to be 0.13 pieces/$\mu m^2$ or less after annealing has been performed, it is necessary to perform spheroidizing annealing on a hot-rolled steel sheet having a microstructure including pearlite and, in terms of volume fraction, 5% or more of pro-eutectoid ferrite. Since a temperature range down to a temperature of 700° C. after finish rolling included in hot rolling has been performed is a temperature range in which ferrite transformation start temperature and pearlite transformation start temperature exist, the cooling rate from the finishing delivery temperature to 700° C. is an important factor in order to control a pro-eutectoid ferrite phase fraction in a steel sheet after hot rolling has been performed to be 5% or more in terms of volume fraction. In the case where the average cooling rate in a temperature range from the finishing delivery temperature to 700° C. is less than 25° C./s, since ferrite transformation is less likely to progress in a short time, which results in an increase in pearlite phase fraction more than necessary, it is not possible to form, in terms of volume fraction, 5% or more of pro-eutectoid ferrite. In addition, since pearlite having a large grain diameter is formed, it is difficult to form the desired steel sheet microstructure after spheroidizing annealing has been performed. Therefore, the average cooling rate in a temperature range down to a temperature of 700° C. after finish rolling has been performed is set to be 25° C./s or more. In addition, since it is preferable that the pro-eutectoid ferrite phase fraction be 10% or more in terms of volume fraction in order to control the number density of cementite grains in ferrite grains to be 0.11 pieces/$\mu m^2$ or less after annealing has been performed, it is preferable that the average cooling rate be 30° C./s or more, or more preferably 40° C./s or more, in this case. On the other hand, in the case where the average cooling rate is more than 150° C./s, it is difficult to form pro-eutectoid ferrite. Therefore, the average cooling rate down to a temperature of 700° C. after finish rolling has been performed is set to be 150° C./s or less, preferably 120° C./s or less, or more preferably 100° C./s or less. Here, this "temperature" refers to the surface temperature of a steel sheet.

Coiling Temperature: 500° C. or Higher and 700° C. or Lower

The steel sheet which has been subjected to finish rolling is wound in a coil shape at a coiling temperature of 500° C. or higher and 700° C. or lower after cooling has been performed as described above. It is not preferable that the coiling temperature be higher than 700° C., because it is not possible to form the desired steel sheet microstructure after annealing has been performed due to an increase in the grain diameter of the microstructure of a hot-rolled steel sheet, and because, from the viewpoint of operational efficiency, there is a case where coil deforms under its own weight due to an excessive decrease in the strength of a steel sheet when the steel sheet is wound in a coil shape. Therefore, the coiling temperature is set to be 700° C. or lower, or preferably 650° C. or lower. On the other hand, in the case where the coiling temperature is lower than 500° C., since there is an increase in the hardness of a steel sheet due to a decrease in the grain diameter of the steel sheet microstructure, there is a decrease in workability due to a decrease in elongation. Therefore, the coiling temperature is set to be 500° C. or higher, or preferably 550° C. or higher. Here, "coiling temperature" refers to the surface temperature of a steel sheet.

Steel Sheet Microstructure after Hot Rolling has been Performed: Including Pearlite and, in Terms of Volume Fraction, 5% or More of Pro-Eutectoid Ferrite In the present disclosure, after spheroidizing annealing has been performed as described below, a steel sheet having a microstructure which includes ferrite and cementite and in which the number density of cementite grains in the ferrite grains is 0.13 pieces/$\mu m^2$ or less is obtained. The microstructure after spheroidizing annealing has been performed is strongly influenced by the steel sheet microstructure after hot rolling has been performed. By forming a steel sheet microstructure including pearlite and, in terms of volume fraction, 5% or more of pro-eutectoid ferrite after hot rolling has been performed, since it is possible to form the desired microstructure after spheroidizing annealing has been performed, it is possible to obtain steel having high workability.

In addition, in the case of a steel sheet having a microstructure which does not include pearlite or in which a pro-eutectoid ferrite phase fraction is less than 5% in terms of volume fraction, since it is not possible to achieve the specified number density of cementite grains after spheroidizing annealing has been performed at a temperature equal to or lower than the $Ac_1$ transformation temperature, there is an increase in the strength of a steel sheet. Therefore, the microstructure of a steel sheet (hot-rolled steel sheet) obtained by performing hot rolling, cooling, and coiling under the conditions described above is a microstructure including pearlite and, in terms of volume fraction, 5% or more of pro-eutectoid ferrite, or preferably, pearlite and, in terms of volume fraction, 10% or more of pro-eutectoid ferrite. Here, in order to achieve a higher level of uniformity in a microstructure after annealing has been performed, it is preferable that the pro-eutectoid ferrite phase fraction be 50% or less in terms of volume fraction.

Annealing Temperature: Equal to or Lower than the $Ac_1$ Transformation Temperature The hot-rolled steel sheet obtained as described above is subjected to annealing (spheroidizing annealing). In the case where the annealing temperature is higher than the $Ac_1$ transformation temperature, since austenite is formed, a pearlite structure having a large grain diameter is formed in a cooling process following the annealing process, which results in a non-uniform microstructure being formed. Therefore, the annealing temperature is set to be equal to or lower than the $Ac_1$ transformation temperature. Here, although there is no particular limitation on the lower limit of the annealing temperature, it is preferable that the annealing temperature be 600° C. or higher, or more preferably 700° C. or higher, in order to control the number density of cementite grains in ferrite grains to be the desired value. Here, as an atmospheric gas, any of nitrogen, hydrogen, and a mixed gas of nitrogen and hydrogen may be used, and, although, it is preferable to use such gases, Ar may also be used without any particular limitation. In addition, it is preferable the annealing time be 0.5 hours or more and 40 hours or less. By controlling the annealing time to be 0.5 hours or more, since it is possible to stably form the desired microstructure, it is possible to control the hardness of a steel sheet to be equal to or lower than the desired value, and it is possible to control elongation to be equal to or more than the desired value. Therefore, it is preferable the annealing time be 0.5 hours or more, or more preferably 8 hours or more. In addition, in the case where the annealing time is more than 40 hours, there is a decrease in productivity, and there is tendency for manufacturing costs to excessively increase. Therefore, it is preferable that the annealing time be 40 hours or less. Here, "annealing temperature" refers to the surface temperature of a steel sheet. In addition, "annealing time" refers to a period of time during which the specified temperature is maintained.

Here, in order to prepare the molten material of the high-carbon steel according to the present disclosure, any of a converter and an electric furnace may be used. In addition, the molten material of the high-carbon steel prepared as described above is made into a slab by using an ingot casting-slabbing method or a continuous casting method. The slab is usually heated and then subjected to hot rolling. Here, in the case of a slab manufactured by using a continuous casting method, hot direct rolling, which is performed on the slab in the cast state or after heat retention has been performed in order to inhibit a fall in temperature, may be performed. In addition, in the case where slab is subjected to hot rolling after heating has been performed, it is preferable that the slab heating temperature be 1280° C. or lower in order to inhibit a deterioration in surface quality due to scale. In hot rolling, in order to perform finish rolling at a specified temperature, the material to be rolled may be heated by using a heating means such as a sheet bar heater in a hot rolling process.

EXAMPLE 1

By preparing molten steels having the chemical compositions corresponding to steel codes A through J given in Table 1, and by then performing finish rolling, cooling, and coiling under the hot rolling conditions given in Table 2, hot rolled steel sheets were obtained. Here, the cooling rates given in Table 2 were the average cooling rates down to a temperature of 700° C. after finish rolling has been performed. Subsequently, by performing pickling, and by performing annealing (spheroidizing annealing) in a nitrogen atmosphere (atmospheric gas: nitrogen) under the annealing conditions given in Table 2, hot-rolled steel sheets (hot-rolled and annealed steel sheets) having a thickness of 4.0 mm and a width of 1000 mm were manufactured. The hardness, elongation, and microstructure of the hot-rolled and annealed steel sheets manufactured as described above were investigated. In addition, the microstructures of the hot-rolled steel sheets before annealing was performed were also investigated. The results are given in Table 2. Here, the $Ar_3$ transformation temperatures and the $Ac_1$ transformation temperatures given in Table 1 were derived by using a formaster.

Hardness (HRB) of Hot-Rolled and Annealed Steel Sheet

By taking a sample from the central portion in the width direction of the annealed steel sheet, and by determining hardness at five points by using a Rockwell hardness meter (B scale), an average value was derived.

Total Elongation (El) of Hot-Rolled and Annealed Steel Sheet

By performing a tensile test at a tensile speed of 10 mm/min on a JIS No. 5 tensile test piece which had been taken from the annealed steel sheet in a direction (L-direction) at an angle of 0° to the rolling direction by using tensile test machine AG-10 TB AG/XR produced by SHIMADZU CORPORATION, and by butting the pieces of a broken sample, elongation (total elongation) was derived.

Microstructure

By observing the microstructure of the hot-rolled steel sheet before annealing was performed (the microstructure of the hot-rolled steel sheet) by using a SEM, the kinds of the microstructures were identified, and a pro-eutectoid ferrite phase fraction was derived. By distinguishing the area of ferrite from the area of other phases, and by deriving the proportion of the area of ferrite in order to deriving an area fraction, the volume fraction of pro-eutectoid ferrite was determined as the obtained area fraction thereof. Here, it was confirmed that pearlite existed in the hot-rolled steel sheet before annealing was performed given in Table 2 in the SEM observation described above.

The microstructure of the hot-rolled steel sheet after annealing had been performed (the microstructure of the hot-rolled and annealed steel sheet) was observed by using microstructure photographs which were captured by using a scanning electron microscope at a magnification of 3000 times at five positions located at a depth of ¼ in the thickness direction of a sample which had been prepared by taking the sample from the central portion in the width direction of the steel sheet, by performing cutting and polishing, and by performing nital etching. By identifying the kinds of the microstructures of the sample, by counting the number of cementite grains which did not exist at grain boundaries and which had a major axis of 0.15 μm or more, and by dividing the number by the area of the fields of view of the photographs, the density of cementite in ferrite grains (the number density of cementite grains in ferrite grains) was derived. By determining the lengths of the major axis and minor axis of each of the cementite grains by using the microstructure photographs described above, the average grain diameter of all the cementite and the average grain diameter of cementite in grains were derived. Ferrite grain diameter was derived by determining grain size by using the microstructure photograph described above, and then average ferrite grain diameter was calculated.

In addition, with respect to the steel sheet after annealing had been performed (hot-rolled and annealed steel sheet), the difference between average N content in a region from the surface to a depth of 150 μm of the surface layer and the average N content of the steel sheet and the proportion of the content of a solid solution B to the content of B were derived by using the following methods. The results are given in Table 2.

Difference Between Average N Content within 150 μm of the Surface Layer and the Average N Content of the Steel Sheet With respect to a sample taken from the central portion in the width direction of the steel sheet after annealing had been performed, average N content within 150 μm of the surface layer and the average N content of the steel sheet were determined, and then the difference between the average N content within 150 μm of the surface layer and the average N content of the steel sheet was derived. Here, "average N content within 150 μm of the surface layer" refers to N content in a region from the surface of the steel sheet to a depth of 150 μm in the thickness direction. In addition, the average N content within 150 μm of the surface layer was derived by using the following method. That is, by starting machining from the surface of a taken sample steel sheet, and by machining the steel sheet to a depth of 150 μm from the surface thereof, the produced cutting chips were collected as samples. The N content within 150 μm of the surface layer was defined as the N content of the samples. The average N content within 150 μm of the surface layer and the average N content of the steel sheet were determined by using an inert gas fusion-thermal conductivity method. A case where the difference between the average N content within 150 μm of the surface layer (N content in a region from the surface to a depth of 150 μm from the surface) and the average N content of the steel sheet (N content in the steel) determined as described above was 30 mass ppm or less may be judged as a case where nitrogen ingress was inhibited.

Proportion of the Content of a Solid Solution B to the Content of B

A sample was taken from the central portion in the width direction of the steel sheet after annealing had been performed. By extracting BN in steel by using 10 vol. %-Br-methanol, by subtracting the content of B which was precipitated in the form of BN from the total content of B in steel, the amount of a solid solution B was derived. The proportion of the content of a solid solution B to the total content of B (B content) in steel was calculated to be equal to {(content of a solid solution B (mass %))/(total B content (mass %))}×100(%). A case where this proportion was 70(%) or more may be judged as a case where a decrease in the content of a solid solution B was inhibited.

Hardness (Quenched Hardness) of a Steel Sheet after Quenching has been Performed In addition, by using the steel sheet after annealing had been performed as a raw material steel sheet, by performing three kinds of quenching treatments as described below, and by investigating the hardness (quenched hardness) of the steel sheet after quenching had been performed, hardenability was evaluated. The results are given in Table 2.

By taking a flat-sheet-type test piece (having a width of 15 mm, a length of 40 mm, and a thickness of 4 mm) from the central portion in the width direction of the steel sheet (raw material steel sheet) after annealing had been performed, a quenching treatment was performed on the flat-sheet-type test piece by using a method in which cooling (water cooling) was performed with water immediately after the test piece had been held at a temperature of 870° C. for 30 seconds or a method in which cooling (120° C.-oil cooling) was performed with oil having a temperature of 120° C. immediately after the test piece had been held at a temperature of 870° C. for 30 seconds. By measuring the hardness at five points in the cut surface of the test piece which had been subjected to the quenching treatment by using a Vickers hardness meter with a load of 1 kgf, and by deriving an average hardness, quenched hardness was defined as the average hardness.

In addition, by taking a disc-type test piece (having a diameter of 55 mmϕ and a thickness of 4 mm) from the central portion in the width direction of the steel sheet (raw material steel sheet) after annealing had been performed, a quenching treatment was also performed by using an induction hardening method (heating the test piece to a temperature of 1000° C. at a heating rate of 200° C./s and then cooling the test piece with water). At this time, by measuring the hardness at two points in the cut surface of the test piece at the outermost periphery of the test piece by using a Vickers hardness meter with a load of 0.2 kgf, and by deriving an average hardness, quenched hardness was defined as the average hardness.

A case where all of the criteria for satisfactory quenched hardness given in Table 3 in the case of water cooling after holding at a temperature of 870° C. for 30 seconds, in the case of 120° C.-oil cooling after holding at a temperature of 870° C. for 30 seconds, and in the case of induction hardening were satisfied was judged as satisfactory (○), that is, the case of excellent hardenability. A case where one of the criteria for satisfactory quenched hardness given in Table 3 in the case of water cooling after holding at a temperature of 870° C. for 30 seconds, in the case of 120° C.-oil cooling after holding at a temperature of 870° C. for 30 seconds, and in the case of water cooling in induction hardening was not satisfied was judged as unsatisfactory (x), that is, the case of poor hardenability. Here, Table 3 indicates the empirical values of quenched hardness corresponding to sufficient hardenability in accordance with C content.

As Table 2 indicates, it is clarified that the hot-rolled steel sheets of the examples of the present disclosure had a microstructure which included ferrite and cementite and in which the number density of cementite grains in the ferrite grains was 0.13 pieces/$\mu m^2$ or less, a hardness of 81 or less in terms of HRB, and a total elongation of 33% or more, which means these hot-rolled steel sheets were excellent in terms of cold workability and hardenability.

TABLE 1

| Steel Code | Chemical Composition (mass %) C | Si | Mn | P | S | sol. Al | N |
|---|---|---|---|---|---|---|---|
| A | 0.42 | 0.01 | 0.39 | 0.01 | 0.003 | 0.038 | 0.0035 |
| B | 0.45 | 0.01 | 0.34 | 0.01 | 0.003 | 0.033 | 0.0038 |
| C | 0.48 | 0.01 | 0.35 | 0.01 | 0.003 | 0.035 | 0.0039 |
| D | 0.45 | 0.01 | 0.39 | 0.01 | 0.003 | 0.033 | 0.0036 |
| E | 0.50 | 0.02 | 0.33 | 0.01 | 0.004 | 0.040 | 0.0033 |
| F | 0.53 | 0.02 | 0.30 | 0.01 | 0.002 | 0.048 | 0.0032 |
| G | 0.48 | 0.01 | 0.40 | 0.01 | 0.003 | 0.037 | 0.0035 |
| H | 0.48 | 0.01 | 0.35 | 0.01 | 0.003 | 0.040 | 0.0038 |
| I | 0.62 | 0.04 | 0.45 | 0.01 | 0.003 | 0.035 | 0.0040 |
| J | 0.58 | 0.03 | 0.40 | 0.01 | 0.003 | 0.038 | 0.0037 |

| Steel Code | Chemical Composition (mass %) B | Sb, Sn, Bi, Ge, Te, Se | Other | $Ac_1$ Transformation Temperature (° C.) | $Ar_3$ Transformation Temperature (° C.) | Note |
|---|---|---|---|---|---|---|
| A | 0.0028 | Sb: 0.009 | — | 719 | 788 | Within Scope of Invention |
| B | 0.0019 | Sb + Sn: 0.015 | — | 720 | 783 | Within Scope of Invention |
| C | 0.0030 | Sb: 0.010 | — | 720 | 779 | Within Scope of Invention |
| D | 0.0035 | Sb: 0.010 | Cr: 0.21 | 719 | 781 | Within Scope of Invention |
| E | 0.0022 | Sb + Ge + Te + Se: 0.010 | Mo: 0.02 | 720 | 779 | Within Scope of Invention |
| F | 0.0017 | Sb + Bi: 0.015 | Ni: 0.05 | 720 | 779 | Within Scope of Invention |
| G | 0.0022 | Sb: 0.009 | — | 719 | 778 | Within Scope of Invention |
| H | 0.0030 | Sb + Sn + Bi + Ge + Te + Se: 0.001 | — | 720 | 781 | Comparative Example |
| I | 0.0029 | Sb + Sn: 0.009 | Cr: 0.21 | 720 | 759 | Within Scope of Invention |
| J | 0.0031 | Sb: 0.010 | Cr: 0.18 | 720 | 765 | Within Scope of Invention |

TABLE 2

| Sample No. | Steel Code | Hot Rolling Condition: Finishing: Delivery Temperature (° C.) | Cooling Rate (° C./s) | Coiling Temperature (° C.) | Microstructure of Hot-rolled Steel Sheet: Volume Fraction of Proeutectoid Ferrite (%) | Spheroidizing Annealing Condition: Annealing Temperature (° C.) | Annealing Time (h) | Microstructure of Hot-rolled and Annealed Steel Sheet: Phase | Cementite Density in Ferrite Grain (piece/μm²) | Average Cementite Grain Diameter (μm) | Average Cementite Grain Diameter in Ferrite Grain (μm) | Average Ferrite Grain Diameter (μm) |
|---|---|---|---|---|---|---|---|---|---|---|---|---|
| 1 | A | 820 | 80 | 620 | 30 | 715 | 30 | Ferrite + Cementite | 0.10 | 0.70 | 0.55 | 9 |
| 2 | A | 830 | 40 | 610 | 25 | 715 | 30 | Ferrite + Cementite | 0.11 | 0.80 | 0.53 | 9 |
| 3 | B | 840 | 60 | 590 | 17 | 715 | 30 | Ferrite + Cementite | 0.10 | 0.70 | 0.55 | 8 |
| 4 | B | 830 | 100 | 620 | 24 | 710 | 25 | Ferrite + Cementite | 0.11 | 0.61 | 0.45 | 9 |
| 5 | B | 900 | 50 | 580 | 3 | 715 | 30 | Ferrite + Cementite | 0.20 | 0.48 | 0.35 | 13 |
| 6 | B | 820 | 125 | 630 | 9 | 710 | 25 | Ferrite + Cementite | 0.12 | 0.62 | 0.46 | 10 |
| 7 | C | 820 | 75 | 600 | 22 | 715 | 30 | Ferrite + Cementite | 0.08 | 0.78 | 0.60 | 9 |
| 8 | C | 840 | 32 | 590 | 14 | 715 | 30 | Ferrite + Cementite | 0.11 | 0.83 | 0.65 | 9 |
| 9 | C | 850 | 29 | 620 | 9 | 715 | 30 | Ferrite + Cementite | 0.12 | 0.75 | 0.58 | 10 |

TABLE 2-continued

| | | | | | | | | | | | | |
|---|---|---|---|---|---|---|---|---|---|---|---|---|
| 10 | C | 840 | 10 | 610 | 4 | 715 | 30 | Ferrite + Cementite | 0.15 | 0.50 | 0.37 | 13 |
| 11 | C | 840 | 160 | 600 | 3 | 715 | 30 | Ferrite + Cementite | 0.15 | 0.45 | 0.30 | 8 |
| 12 | D | 840 | 70 | 620 | 26 | 715 | 30 | Ferrite + Cementite | 0.10 | 0.65 | 0.47 | 9 |
| 13 | E | 830 | 80 | 650 | 20 | 715 | 30 | Ferrite + Cementite | 0.11 | 0.76 | 0.61 | 12 |
| 14 | F | 820 | 80 | 630 | 18 | 715 | 30 | Ferrite + Cementite | 0.11 | 0.78 | 0.58 | 11 |
| 15 | G | 820 | 80 | 610 | 29 | 715 | 30 | Ferrite + Cementite | 0.07 | 0.85 | 0.62 | 9 |
| 16 | H | 840 | 50 | 610 | 20 | 715 | 30 | Ferrite + Cementite | 0.07 | 0.86 | 0.70 | 10 |
| 17 | I | 820 | 70 | 590 | 16 | 715 | 30 | Ferrite + Cementite | 0.11 | 0.78 | 0.59 | 8 |
| 18 | J | 820 | 50 | 600 | 18 | 715 | 30 | Ferrite + Cementite | 0.07 | 0.79 | 0.60 | 7 |
| 19 | J | 820 | 50 | 750 | 15 | 720 | 50 | Ferrite + Cementite | 0.02 | 1.50 | 0.80 | 13 |

| | Property of Hot-rolled and Annealed Steel Sheet | | Difference in Average N Concentration between Region within 150 μm of Surface | | | Hardness of Quenched Steel Sheet (Hv)* | | | | | |
|---|---|---|---|---|---|---|---|---|---|---|---|
| Sample No. | Hardness (HRB) | Elongation (%) | Layer and Steel Sheet (mass ppm) | Content of Solid Solution B (mass %) | (Content of Solid Solution B)/(Total B Content) × 100 (%) | Water Cooling | 120° C.-Oil Cooling | Induction hardening | Evaluation of Cold Workability | Evaluation of Hardenability* | Note |
| 1 | 74 | 37 | 20 | 0.0025 | 89 | 641 | 570 | 635 | ○ | ○ | Example |
| 2 | 75 | 37 | 20 | 0.0024 | 86 | 643 | 572 | 638 | ○ | ○ | Example |
| 3 | 78 | 40 | 20 | 0.0017 | 89 | 690 | 610 | 685 | ○ | ○ | Example |
| 4 | 77 | 40 | 20 | 0.0016 | 84 | 680 | 615 | 675 | ○ | ○ | Example |
| 5 | 82 | 32 | 20 | 0.0016 | 84 | 685 | 612 | 680 | x | ○ | Comparative Example |
| 6 | 81 | 33 | 20 | 0 0016 | 84 | 683 | 610 | 680 | ○ | ○ | Example |
| 7 | 77 | 37 | 20 | 0.0026 | 87 | 690 | 640 | 683 | ○ | ○ | Example |
| 8 | 78 | 35 | 20 | 0.0027 | 90 | 691 | 642 | 685 | ○ | ○ | Example |
| 9 | 78 | 36 | 20 | 0.0026 | 87 | 685 | 637 | 681 | ○ | ○ | Example |
| 10 | 84 | 32 | 20 | 0.0025 | 83 | 690 | 641 | 685 | x | ○ | Comparative Example |
| 11 | 86 | 31 | 20 | 0.0027 | 90 | 692 | 639 | 682 | x | ○ | Comparative Example |
| 12 | 78 | 33 | 20 | 0.0033 | 94 | 683 | 615 | 680 | ○ | ○ | Example |
| 13 | 81 | 33 | 20 | 0.0016 | 73 | 713 | 673 | 710 | ○ | ○ | Example |
| 14 | 81 | 33 | 20 | 0.0014 | 82 | 750 | 680 | 745 | ○ | ○ | Example |
| 15 | 77 | 35 | 20 | 0.0020 | 91 | 760 | 700 | 750 | ○ | ○ | Example |
| 16 | 78 | 35 | 180 | 0.0004 | 13 | 605 | 410 | 595 | ○ | x | Comparative Example |
| 17 | 81 | 33 | 20 | 0.0024 | 83 | 750 | 680 | 745 | ○ | ○ | Example |
| 18 | 80 | 34 | 20 | 0.0028 | 90 | 760 | 700 | 750 | ○ | ○ | Example |
| 19 | 63 | 42 | 20 | 0.0019 | 61 | 745 | 675 | 650 | ○ | x | Comparative Example |

TABLE 3

| C content (mass %) | Hardness of Sample Water-cooled after Holding at 870° C. for 30 s (HV) | Hardness of Sample 120° C.-oil-cooled after Holding at 870° C. for 30 s (HV) | Hardness of Sample Water-cooled in Induction hardening (HV) |
|---|---|---|---|
| more than 0.40 and less than 0.42 | >620 | >550 | >615 |
| 0.42 or more and less than 0.45 | ≥630 | ≥560 | ≥625 |
| 0.45 or more and less than 0.48 | ≥650 | ≥580 | ≥645 |
| 0.48 or more and less than 0.51 | ≥670 | ≥600 | ≥665 |
| 0.51 or more and less than 0.53 | ≥700 | ≥630 | ≥695 |
| 0.53 or more and 0.63 or less | ≥740 | ≥670 | ≥735 |

The invention claimed is:

1. A high-carbon hot-rolled steel sheet having a chemical composition comprising:

C: more than 0.40% and 0.63% or less, by mass %;

Si: 0.10% or less, by mass %;

Mn: 0.50% or less, by mass %;

P: 0.03% or less, by mass %;

S: 0.010% or less, by mass %;

sol.Al: 0.10% or less, by mass %;

N: 0.0050% or less, by mass %;

B: 0.0005% or more and 0.0050% or less, by mass %;

at least one of Sb, Sn, Bi, Ge, Te, and Se in an amount of 0.002% or more and 0.030% or less in total, by mass %; and a balance of Fe and inevitable impurities, wherein:

a proportion of a content of a solid solution B to a content of B is 70% or more, the steel sheet has a microstructure including ferrite and cementite, an average grain diameter of the ferrite is 7 μm or more and 12 μm or less, a density of cementite in ferrite grains is 0.13 pieces/$\mu m^2$ or less, the steel sheet has a hardness of 81 or less in terms of HRB, the steel sheet has a total elongation of 33% or more, and a difference between an average nitrogen concentration in a region from a surface to a depth of 150 μm in a thickness direction of the steel sheet and an average nitrogen concentration in a whole of the steel sheet is 30 mass ppm or less.

2. The high-carbon hot-rolled steel sheet according to claim 1, wherein the chemical composition of the steel sheet further comprises at least one of Ni, Cr, and Mo in an amount of 0.50% or less in total, by mass %.

3. The high-carbon hot-rolled steel sheet according to claim 1, wherein:

an average grain diameter of all the cementite in the steel sheet is 0.60 μm or more and 1.00 μm or less, and an average grain diameter of the cementite in the ferrite grains is 0.40 μm or more.

4. A method for manufacturing the high-carbon hot-rolled steel sheet according to claim 1, the method comprising:

performing hot rough rolling on steel having a chemical composition according to claim 1;

then, after the hot rough rolling, performing hot finish rolling with a finishing delivery temperature equal to or higher than Ara transformation temperature and 870° C. or lower;

then, after the hot finish rolling, cooling the hot-rolled steel sheet to a temperature of 700° C. at an average cooling rate of 25° C./s or more and 150° C./s or less;

then, after the cooling, coiling the cooled steel sheet at a coiling temperature of 500° C. or higher and 700° C. or lower in order to obtain a steel sheet having a microstructure including pearlite and, in terms of volume fraction, 5% or more of pro-eutectoid ferrite; and then, after the coiling, annealing the steel sheet at a temperature equal to or lower than $Ac_1$ transformation temperature.

5. The method for manufacturing a high-carbon hot-rolled steel sheet according to claim 4, wherein the chemical composition of the steel further comprises at least one of Ni, Cr, and Mo in an amount of 0.50% or less in total, by mass %.

6. The high-carbon hot-rolled steel sheet according to claim 1, wherein the density of the cementite in the ferrite grains is 0.10 pieces/$\mu m^2$ or less.

7. The high-carbon hot-rolled steel sheet according to claim 1, wherein the microstructure of the steel sheet further includes pearlite and, in terms of volume fraction, 5% or more of pro-eutectoid ferrite.

8. The method for manufacturing a high-carbon hot-rolled steel sheet according to claim 4, wherein the density of the cementite in the ferrite grains is 0.10 pieces/$\mu m^2$ or less.

9. The high-carbon hot-rolled steel sheet according to claim 1, wherein the density of cementite in ferrite grains is 0.11 pieces/$\mu m^2$ or less.

* * * * *